US011540960B2

(12) United States Patent
Matheny et al.

(10) Patent No.: US 11,540,960 B2
(45) Date of Patent: Jan. 3, 2023

(54) SIT TO STAND STAIR CHAIR

(71) Applicant: Stryker Corporation, Kalamazoo, MI (US)

(72) Inventors: Nathan Matheny, Portage, MI (US); Brandon David Naber, Portage, MI (US); Daniel V. Brosnan, Kalamazoo, MI (US); Cory P. Herbst, Shelbyville, MI (US); Jeffrey R. Staszak, Deerfield, WI (US); Erik P. Eagleman, Madison, WI (US); Scott I. Biba, Waunakee, WI (US)

(73) Assignee: Stryker Corporation, Kalamazoo, MI (US)

( * ) Notice: Subject to any disclaimer, the term of this patent is extended or adjusted under 35 U.S.C. 154(b) by 430 days.

(21) Appl. No.: 16/705,859

(22) Filed: Dec. 6, 2019

(65) Prior Publication Data

US 2020/0179197 A1 Jun. 11, 2020

Related U.S. Application Data

(60) Provisional application No. 62/776,801, filed on Dec. 7, 2018.

(51) Int. Cl.
*A61G 5/14* (2006.01)
*A61G 5/06* (2006.01)
(Continued)

(52) U.S. Cl.
CPC ..... *A61G 5/14* (2013.01); *A61G 5/061* (2013.01); *A61G 5/066* (2013.01); *A61G 5/1059* (2013.01);
(Continued)

(58) Field of Classification Search
CPC ..... A61G 5/14; A61G 5/061; A61G 5/1059; A61G 5/1086; A61G 5/1089; A61G 5/128
See application file for complete search history.

(56) References Cited

U.S. PATENT DOCUMENTS 3,869,011 A * 3/1975 Jensen ..... A61G 5/061 280/5.22
4,962,941 A * 10/1990 Rembos ..... A61G 5/066 297/DIG. 10
(Continued)

FOREIGN PATENT DOCUMENTS

CN 204501286 U * 7/2015
CN 207898598 U * 9/2018
(Continued)

OTHER PUBLICATIONS

Mobile Stairlift, "Mobile Stair Lift and Accessories Webpage", https://www.mobilestairlift.com/collections/mobile-stairlift-accessories, 2019, 5 pages.
(Continued)

*Primary Examiner* — Ryan D Kwiecinski
(74) *Attorney, Agent, or Firm* — Howard & Howard Attorneys PLLC

(57) ABSTRACT

A stair chair for use in transporting a patient in a seated position along stairs comprising a base, an upright coupled to the base, and a track assembly extending from the base for traversing stairs. A seat section is operatively attached to the upright and arranged for movement relative to the base between a plurality of vertical configurations including a first vertical configuration where the seat section is spaced from the base at a first distance for supporting the patient in the seated position, and a second vertical configuration where the seat section is spaced from the base at a second distance greater than the first distance. A lift mechanism is interposed between the base and the seat section to move the
(Continued)

seat section between the plurality of vertical configurations. The lift mechanism moves the seat section to facilitate transitioning the patient to a standing position from the seated position.

20 Claims, 12 Drawing Sheets

(51) Int. Cl.
*A61G 5/10* (2006.01)
*E04F 11/02* (2006.01)

(52) U.S. Cl.
CPC ..... *E04F 11/02* (2013.01); *A61G 2203/18* (2013.01); *E04F 2011/0203* (2013.01)

(56) References Cited

U.S. PATENT DOCUMENTS

| | | | | |
|---|---|---|---|---|
| 5,601,302 | A * | 2/1997 | Beard | A61G 5/1059 280/250.1 |
| 6,431,650 | B1 * | 8/2002 | Visone | A61G 5/125 297/411.36 |
| 6,648,343 | B2 | 11/2003 | Way et al. | |
| 6,935,648 | B2 * | 8/2005 | Beck | A61G 5/1054 280/250.1 |
| 7,273,255 | B2 | 9/2007 | Nylander et al. | |
| 8,307,473 | B1 * | 11/2012 | Lambarth | A61G 5/061 5/81.1 R |
| 8,640,798 | B2 | 2/2014 | Walkingshaw et al. | |
| 9,004,204 | B2 | 4/2015 | Walkingshaw et al. | |
| 9,486,373 | B2 | 11/2016 | Lambarth et al. | |
| 9,510,981 | B2 | 12/2016 | Lambarth et al. | |
| 9,593,833 | B2 * | 3/2017 | McMannon | F21V 23/0464 |
| 10,391,007 | B2 * | 8/2019 | Bryant | A61G 5/104 |
| 10,918,544 | B2 * | 2/2021 | Abdullah | A61G 5/14 |
| 11,077,002 | B1 * | 8/2021 | Crump | A61G 5/1067 |
| 2005/0046255 | A1 * | 3/2005 | Bressler | A61G 5/14 297/326 |
| 2008/0133089 | A1 * | 6/2008 | Bayomy | A61G 5/1054 297/217.3 |
| 2014/0084553 | A1 * | 3/2014 | Carletti | A61G 5/0833 280/5.22 |
| 2017/0079859 | A1 | 3/2017 | Lambarth et al. | |
| 2019/0380895 | A1 * | 12/2019 | Bryant | A61G 5/104 |
| 2020/0113757 | A1 * | 4/2020 | Abdullah | A61G 5/1059 |
| 2020/0179197 | A1 * | 6/2020 | Matheny | A61G 5/066 |
| 2021/0196539 | A1 * | 7/2021 | Wallace | A61G 5/1008 |
| 2021/0338497 | A1 * | 11/2021 | Lambarth | A61G 1/025 |

FOREIGN PATENT DOCUMENTS

| | | | | |
|---|---|---|---|---|
| CN | 109091319 | A * | 12/2018 | A61G 5/061 |
| CN | 209548253 | U * | 10/2019 | |
| CN | 113143613 | A * | 7/2021 | |
| EP | 773009 | A2 * | 5/1997 | A61G 5/023 |
| WO | WO-0047154 | A2 * | 8/2000 | A61G 5/1002 |
| WO | WO-2019191097 | A1 * | 10/2019 | A61G 5/1059 |
| WO | WO-2021138175 | A1 * | 7/2021 | A61G 5/061 |

OTHER PUBLICATIONS

Mobile Stairlift, "Motorized Stair Chair, Portable Stair Lift—Motorized Chair Lift—Battery Powered Video and Webpage", https://www.mobilestairlift.com/products/mobile-stairlift-battery-powered-portable, 2019, 5 pages.

Youtube, "Video: How to Use the Mobile Stairlift Dolly—An Introductory Guide", https://www.youtube.com/watch?v=BQt3-q73Zyg, Apr. 10, 2018, 1 page.

Youtube, "Video: Introducing the Mobile Stairlift—Portablee Stair Climbing Wheelchair", https://www.youtube.com/watch?v=QhBhuuoeyd4, Apr. 10, 2018, 1 page.

Youtube, "Video: ST003A Plus New Type Mobility Stair Climber Chair for Lifting Elderly", https://www.youtube.com/watch?v=_ltZ1Nbpf-0, Apr. 5, 2018, 1 page.

* cited by examiner

SIT TO STAND STAIR CHAIR

CROSS-REFERENCE TO RELATED APPLICATION

The subject patent application claims priority to and all the benefits of U.S. Provisional Patent Application No. 62/776,801 filed on Dec. 7, 2018, the disclosure of which is hereby incorporated by reference in its entirety.

BACKGROUND

In many instances, a person with limited mobility may have difficulty navigating stairs, which may be the only viable option for exiting a building in certain emergency situations. In order for a caregiver to transport a patient along stairs in a safe and controlled manner, a stair chair may be employed. Stair chairs are adapted to transport patients in a seated position up or down stairs, with two caregivers typically supporting, stabilizing, or otherwise carrying the stair chair with the stair chair. Certain types of conventional stair chairs may include a seat section to provide support to the patient, and a track assembly to help smoothly traverse each stair. Typically, the caregiver will assist the patient with ingress and egress to the stair chair, however some patients may require additional assistance.

A patient transport apparatus designed to overcome one or more of the aforementioned challenges is desired.

BRIEF DESCRIPTION OF THE DRAWINGS

Other advantages of the present invention will be readily appreciated as the same becomes better understood by reference to the following detailed description when considered in connection with the accompanying drawings.

DETAILED DESCRIPTION OF THE EMBODIMENTS

Figure 1A:
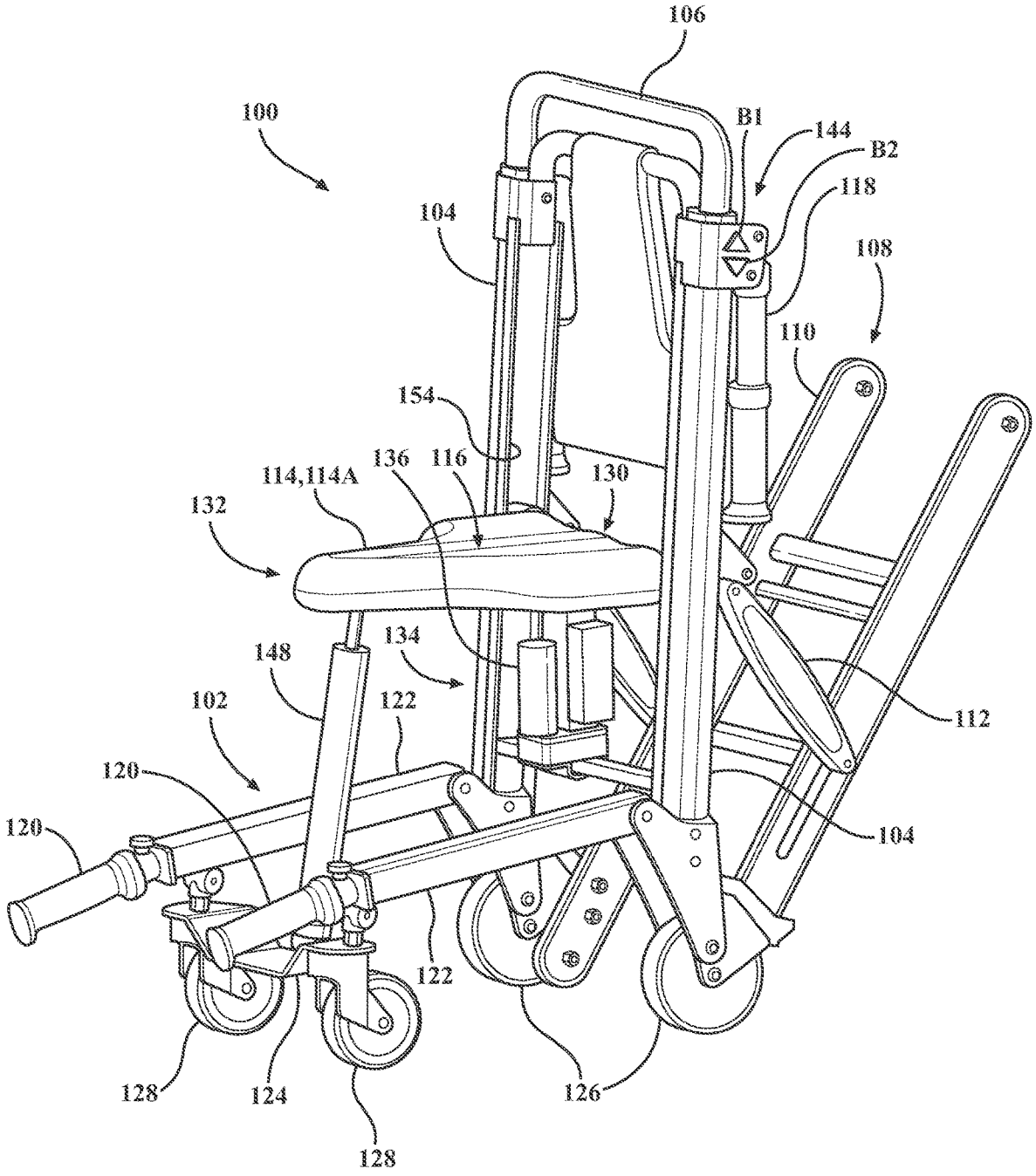
FIG. 1A is a perspective view of a first embodiment of a stair chair comprising a lift mechanism and a seat section, with the seat section shown in a first vertical configuration.

With reference to the drawings, wherein like numerals indicate like parts throughout the several views, the present disclosure is directed toward a stair chair, generally indicated at 100 in FIG. 1A. The stair chair 100 comprises a base 102 and an upright 104 coupled to the base 102. More specifically, the upright 104 is coupled to the base 102 at a bottom end and extends in a generally vertical direction away from the base 102. The base 102 comprises two lower rails 122 that extend from a front of the stair chair 100 to a rear of the stair chair 100. Here, it will be appreciated that the terms "front" and "rear" generally correspond with an orientation of a patient seated on the stair chair 100 (see FIG. 3A) where the front is associated with a forward facing direction of the patient and the rear is associated with the a rearward facing direction of the patient. The lower rails 122 extend forward to a foot support 124. The foot support 124 is coupled to each of the lower rails 122 and defines a platform upon which the patient's feet may be supported.

To facilitate movement along a floor surface, the stair chair 100 may comprise wheels coupled to the base 102. In the illustrated embodiments, two rear wheels 126 are coupled to the lower rails 122 at the rear of the stair chair 100, with one rear wheel 126 coupled to each lower rail 122. A front wheel 128 is pivotably coupled to the foot support 124 at the front of the stair chair 100. In the embodiment shown, the front wheel 128 is further defined as two caster wheels each coupled to the foot support 124. In other embodiments (not shown) the stair chair 100 may be configured such that both the front wheels 128 and the rear wheels 126 are realized as caster wheels. Conversely, some embodiments may utilize non-pivoting wheels for both the front wheels 128 and the rear wheels 126. Other configurations are contemplated.

In the embodiment shown, the stair chair 100 employs two uprights 104 coupled to opposing sides of the base 102. Each upright 104 extends away from the base 102 to an upper stabilizer 106. The upper stabilizer 106 is disposed between the uprights 104. The uprights 104 and the upper stabilizer 106 may be of unitary construction, such as where the upright 104 is bent or otherwise shaped so as to form a U-shaped profile. The uprights 104 may also be formed as discrete components with the upper stabilizer 106 coupled to each upright 104 (not shown). In addition to stabilizing the uprights 104, the upper stabilizer 106 may be used by a caregiver as a handle to move the stair chair 100. In some embodiments, the upper stabilizer 106 may be movable relative to the uprights 104. For example, the upper stabilizer 106 may be inserted into the upright 104 and telescope to different positions to reach a height more comfortable for the caregiver. Clamps or similar brackets may be used to restrict the height of the upper stabilizer 106 between several positions. Other configurations are contemplated.

In addition to the upper stabilizer 106, the stair chair 100 may comprise two upper handles 118 in some embodiments.

In the embodiment illustrated, each of the upper handles 118 is pivotably coupled to one of the uprights 104 and are generally deployed by pivoting to a locked position (not shown) such that the caregiver can grasp the upper handles 118 during certain use scenarios, such as while going up stairs or going down stairs.

The stair chair 100 further comprises a track assembly 108 extending from the base 102. The track assembly 108 comprises a pair or track members 110 which are provided to help facilitate traversing stairs. The track assembly 108 extends from the base 102 at an oblique angle which, among other things, helps balance the weight of the stair chair 100 and the patient while traversing stairs. A track brace 112 is disposed between the upright 104 and the track assembly 108 to distribute the weight of the stair chair 100 and the patient along the track assembly 108. A first end of the track brace 112 is pivotably coupled to the upright 104, and a second end is movably coupled to the track assembly 108 in a slot, which facilitates folding the track assembly 108 into a stowed position.

The track members 110 slide against the stairs when the stair chair 100 is ascending and/or descending stairs. In some embodiments, the track assembly 108 may include a movable belt disposed about the track members 110 that engage the stairs. The belts ride along and are supported by rollers (not shown) of the respective track members 110, which rotate while traversing stairs. The track assembly 108 may further include brakes and/or a drive system (not shown) which cooperate with or otherwise define the belt and are configured to slow the stair chair 100 while descending stairs and/or propel the stair chair 100 while ascending stairs. In some embodiments, the brakes may be realized as part of the drive system or part of the track members 110, or may be realized with separate components. Likewise, the drive system may be implemented into one or both of the track members 110. Other configurations are contemplated.

The stair chair 100 further comprises a seat section 114 defining a patient support surface 116. The seat section 114 provides support for a patient engaging the patient support surface 116, is operatively attached to the upright 104, and is arranged for movement relative to the base 102 between a plurality of vertical configurations. The seat section 114 is shown in an exemplary first vertical configuration 114A in FIGS. 1A, 2A, 3A, and 4A, and in an exemplary second vertical configuration 114B in FIGS. 1B, 2B, 3B, and 4B. In the first vertical configuration 114A the seat section 114 is spaced from the base 102 at a first distance L1 (see FIG. 2A) for supporting the patient in a seated position. In the second vertical configuration 114B the seat section 114 is spaced from the base 102 at a second distance L2 (see FIG. 2B) greater than the first distance L1.

In addition to the seat section 114 the stair chair 100 further comprises a seatback 160 coupled to the uprights 104. The seatback 160 supports the patient's back when seated on the seat section 114. The seatback 160 may be coupled to the seat section 114 for concurrent movement between the plurality of vertical configurations in some embodiments. Other configurations are contemplated.

Figure 4A:
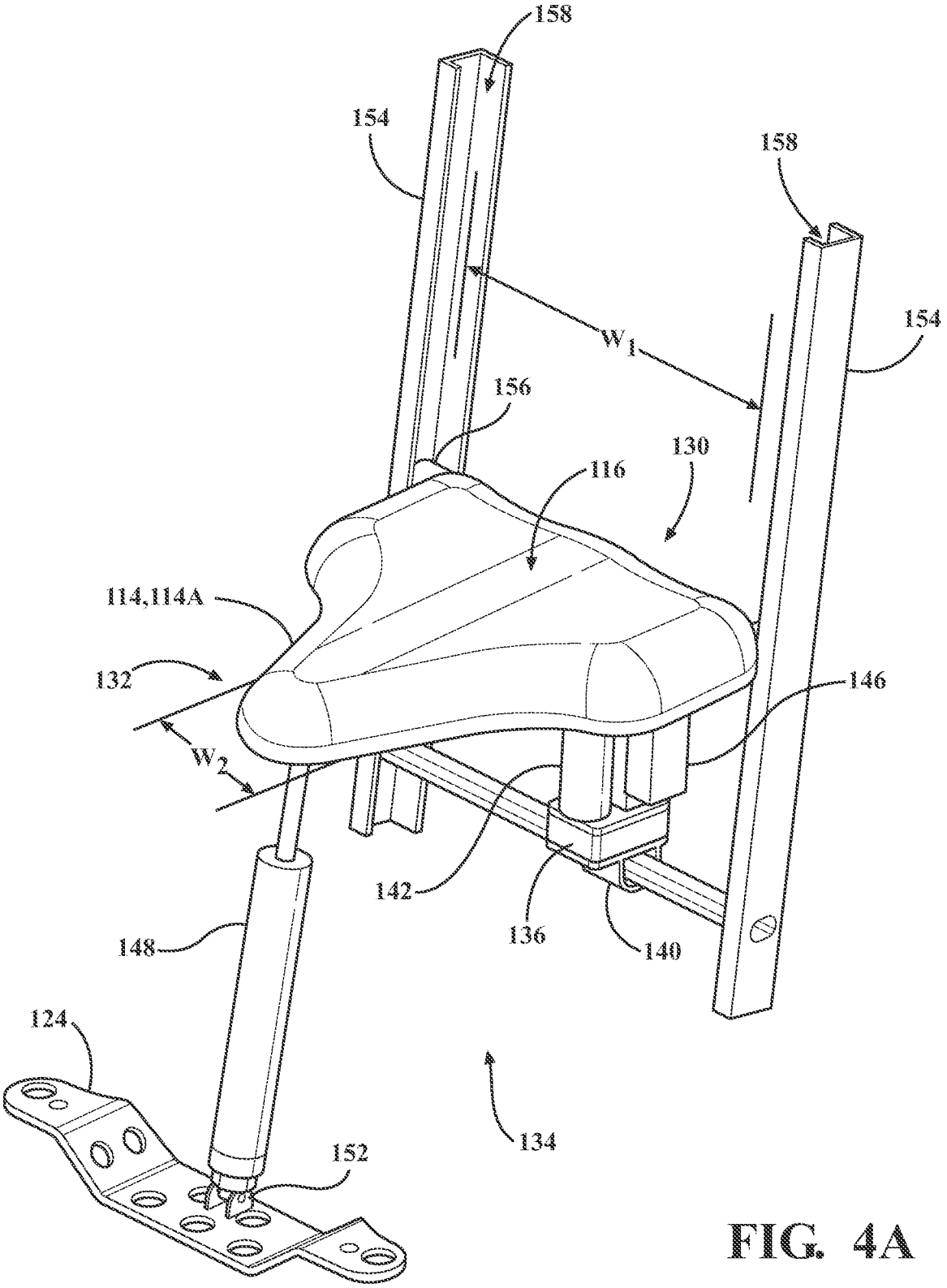
FIG. 4A is a top-side perspective view of the lift mechanism and seat section of FIG. 1 with the seat section in the first vertical configuration.
Figure 5:
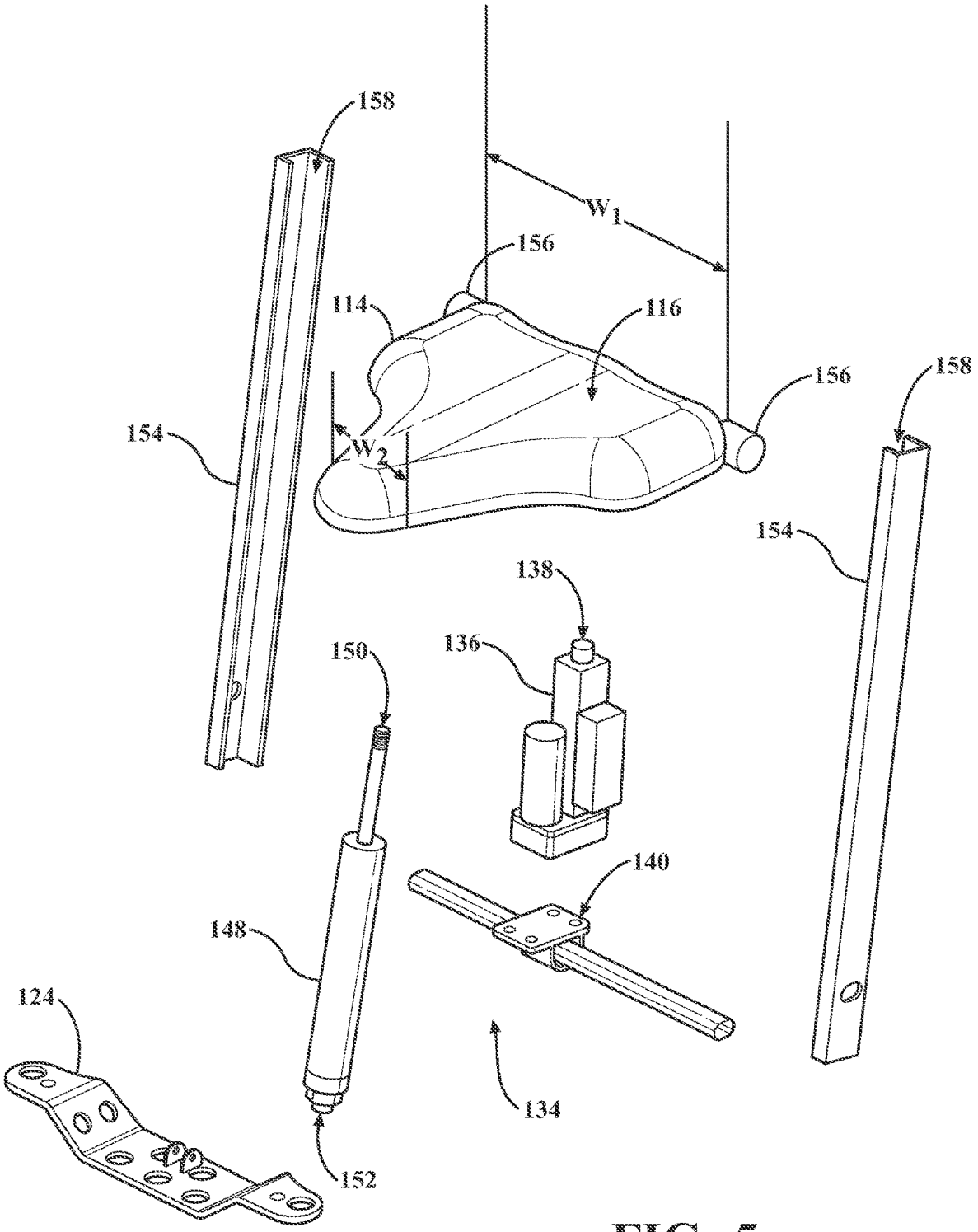
FIG. 5 is an exploded view of the lift mechanism and seat section for the stair chair.
Figure 6A:
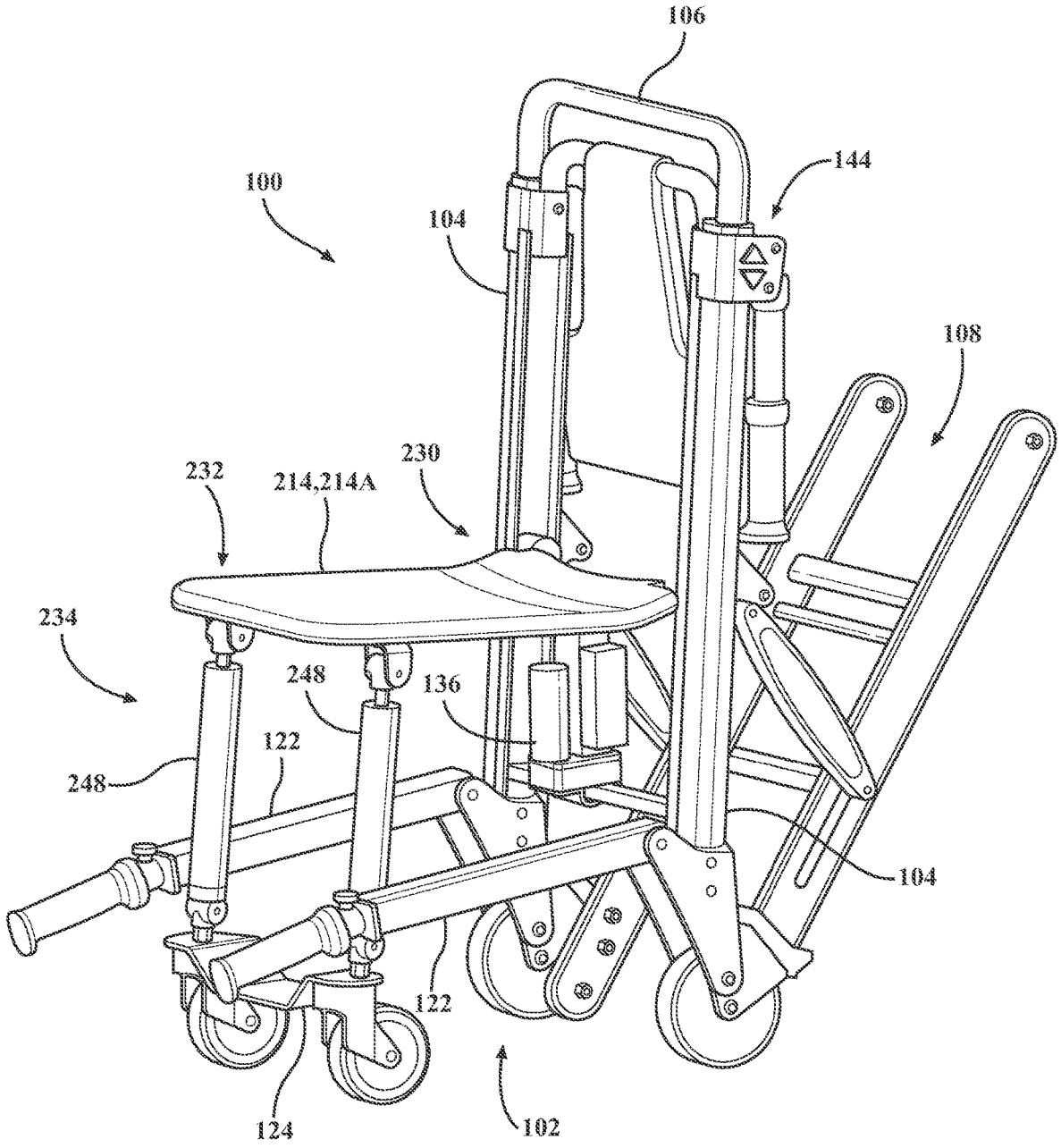
FIG. 6A is a perspective view of a second embodiment of a stair chair comprising a lift mechanism and a seat section, with the seat section shown in a first vertical configuration.
Figure 6B:
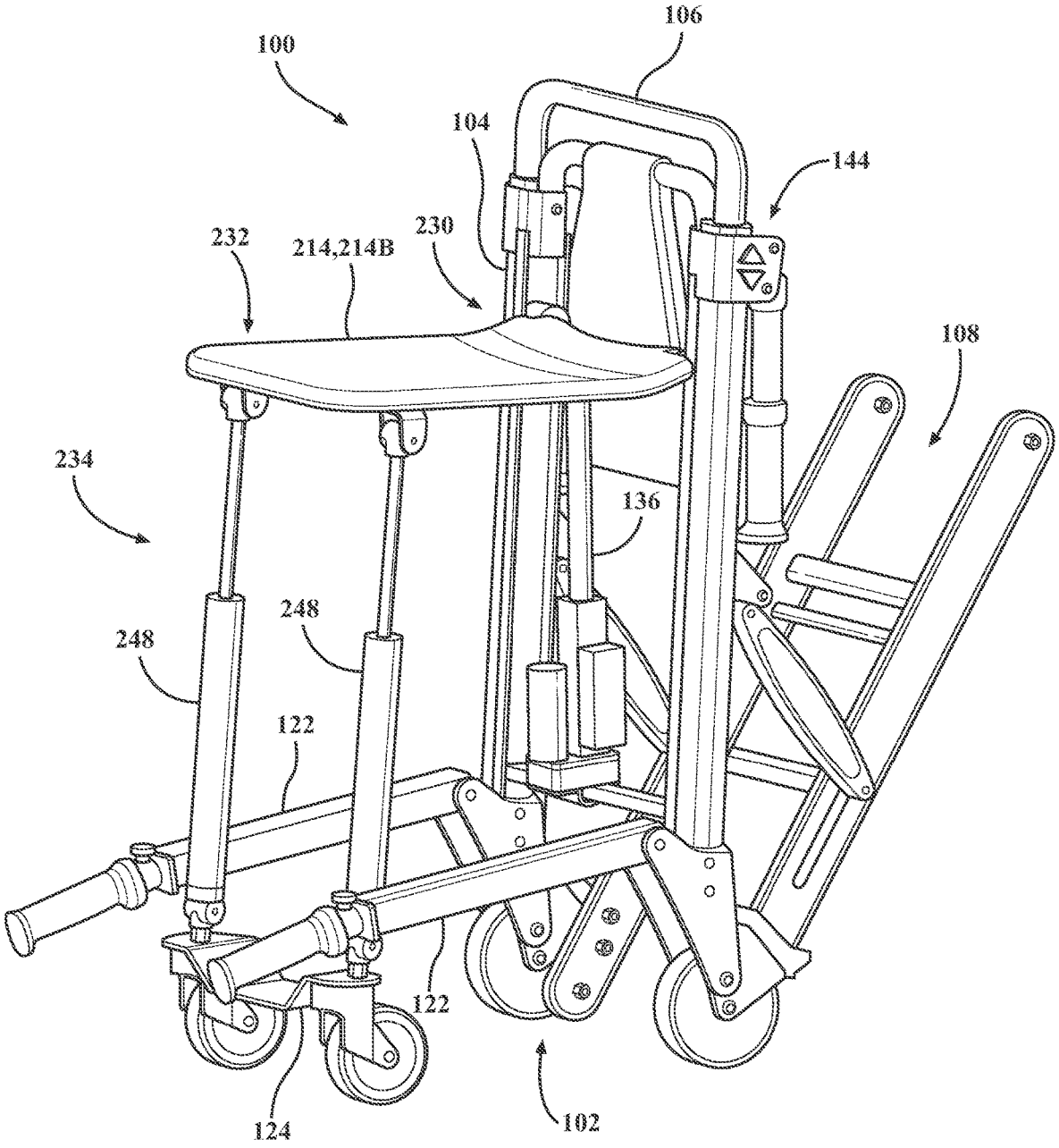
FIG. 6B is a perspective view of the stair chair of FIG. 6A with the seat section shown in a second vertical configuration.
Figure 7:
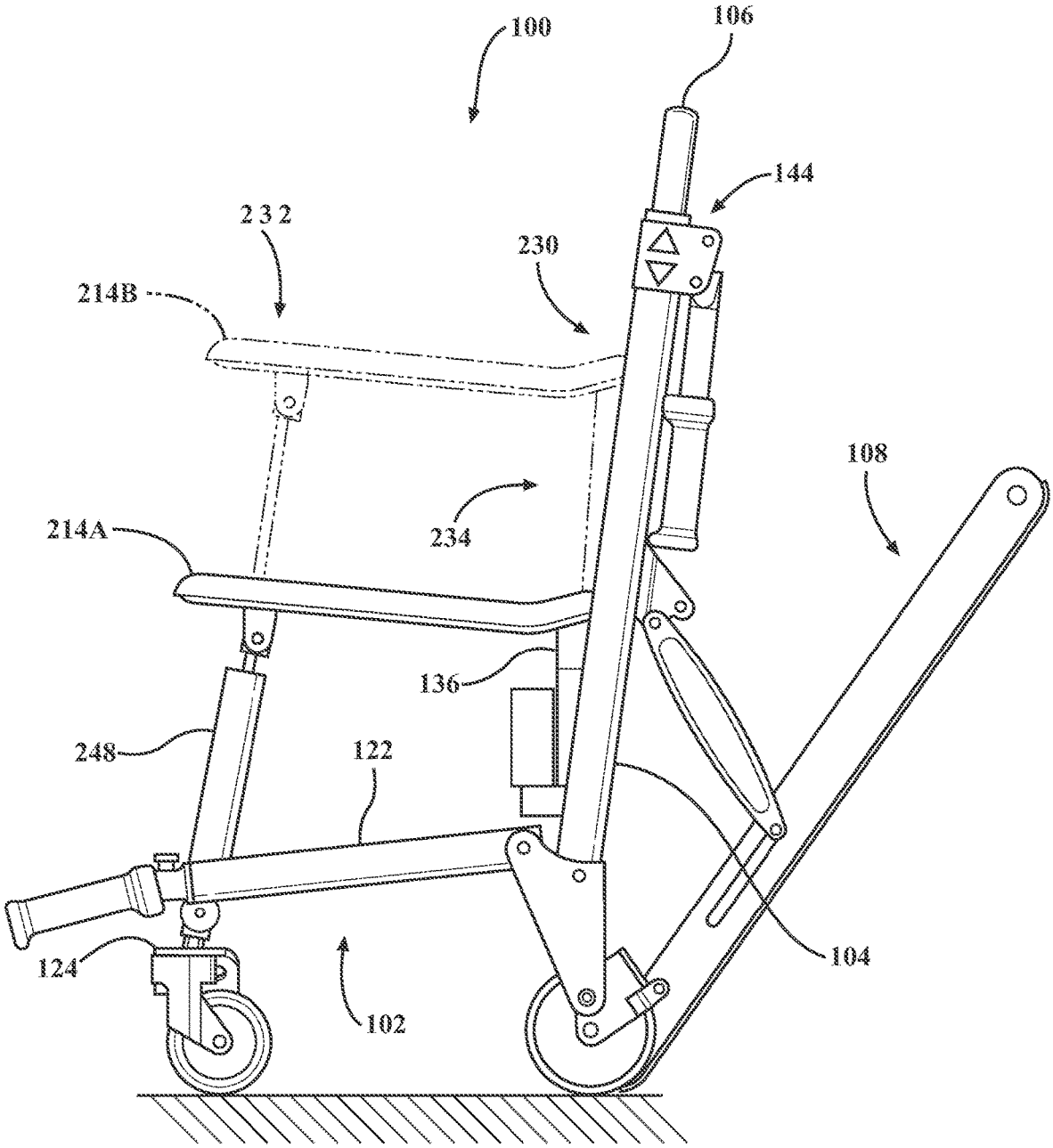
FIG. 7 is a side view of the stair chair of FIG. 6A with the seat section in the first vertical configuration and with the second vertical configuration shown in phantom.
Figure 8:
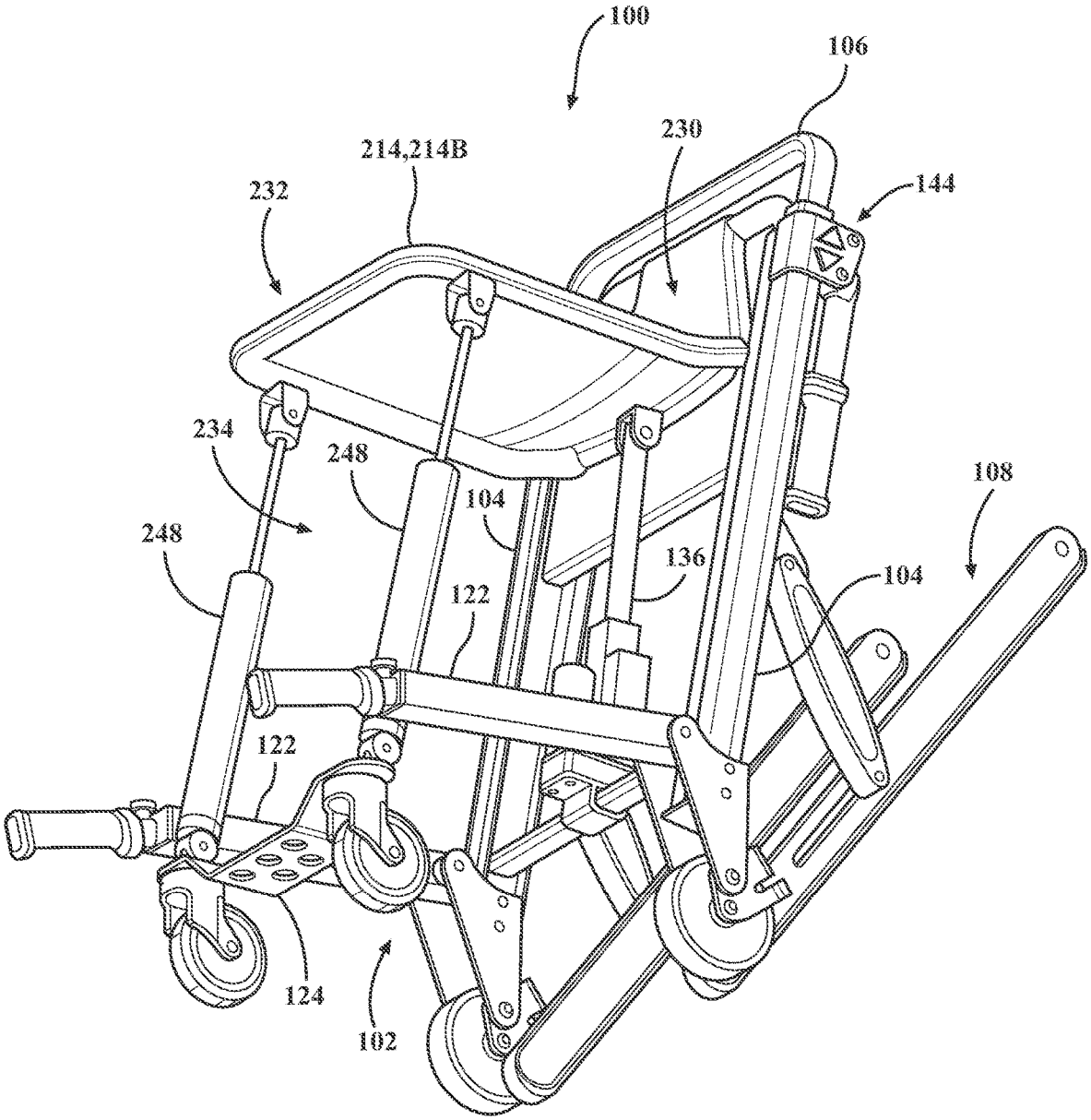
FIG. 8 is a bottom-side perspective view of the stair chair of FIG. 6B with the seat section in the second vertical configuration.
Figure 9:
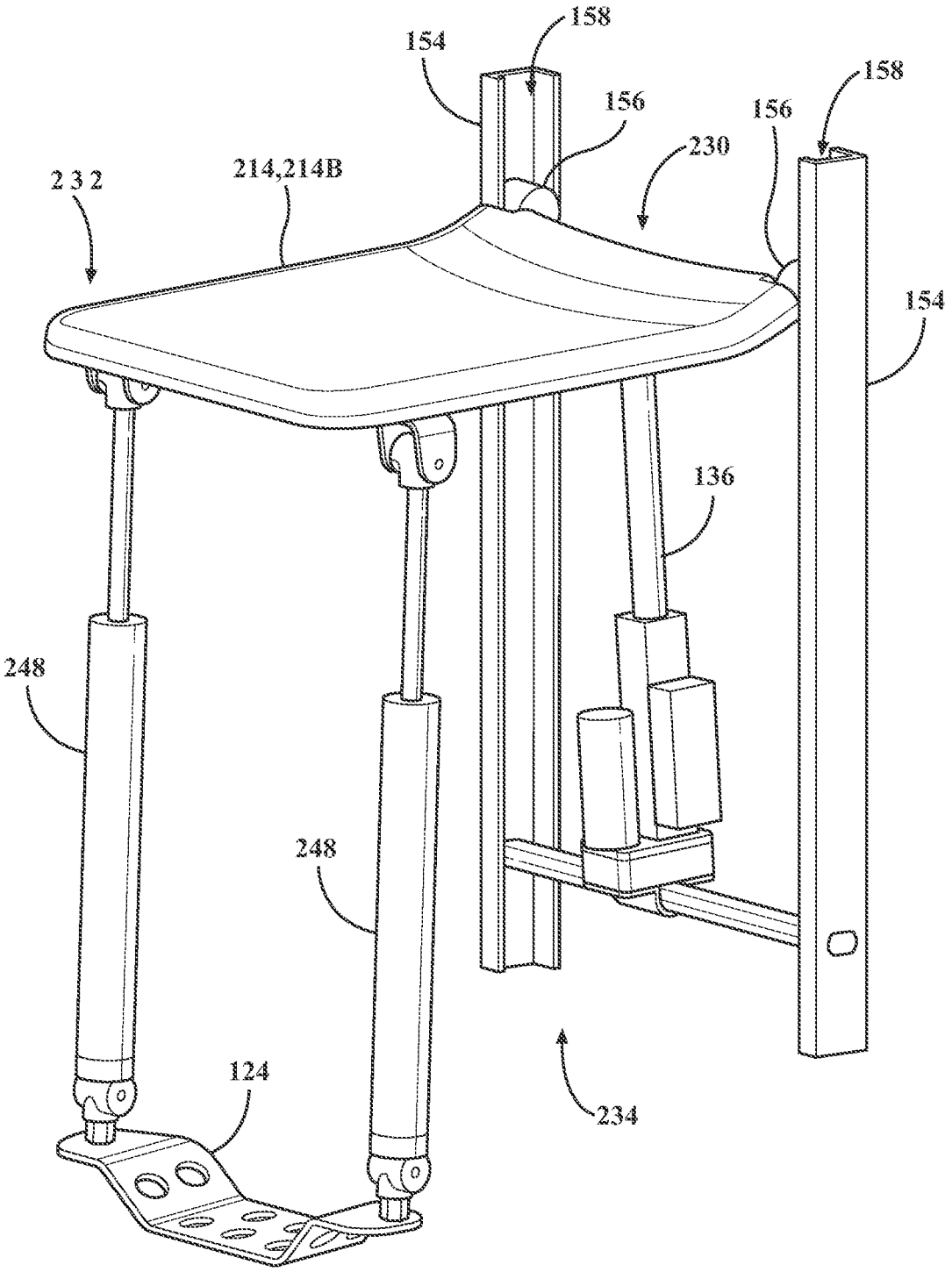
FIG. 9 is a top-side perspective view of the lift mechanism and seat section of FIG. 6B with the seat section in the second vertical configuration.

As is best shown in FIGS. 4A and 5, the seat section 114 extends between a rear portion 130 and a front portion 132. The rear portion 130 of the seat section 114 is coupled to the uprights 104 and defines a rear width W1 and the front portion 132 defines a front width W2. In this embodiment, the front width W2 is at least partially smaller than the rear width W1 such that the seat section 114 tapers between the front portion 132 and the rear portion 130. This configuration provides the seat section 114 with a saddle-shaped profile defining the patient support surface 116. The saddle-shaped profile helps to direct the patient's legs to straddle the seat section 114 with the front portion 132 positioned between the patient's legs and the rear portion 130 engaging the patient's buttocks.

Figure 3B:
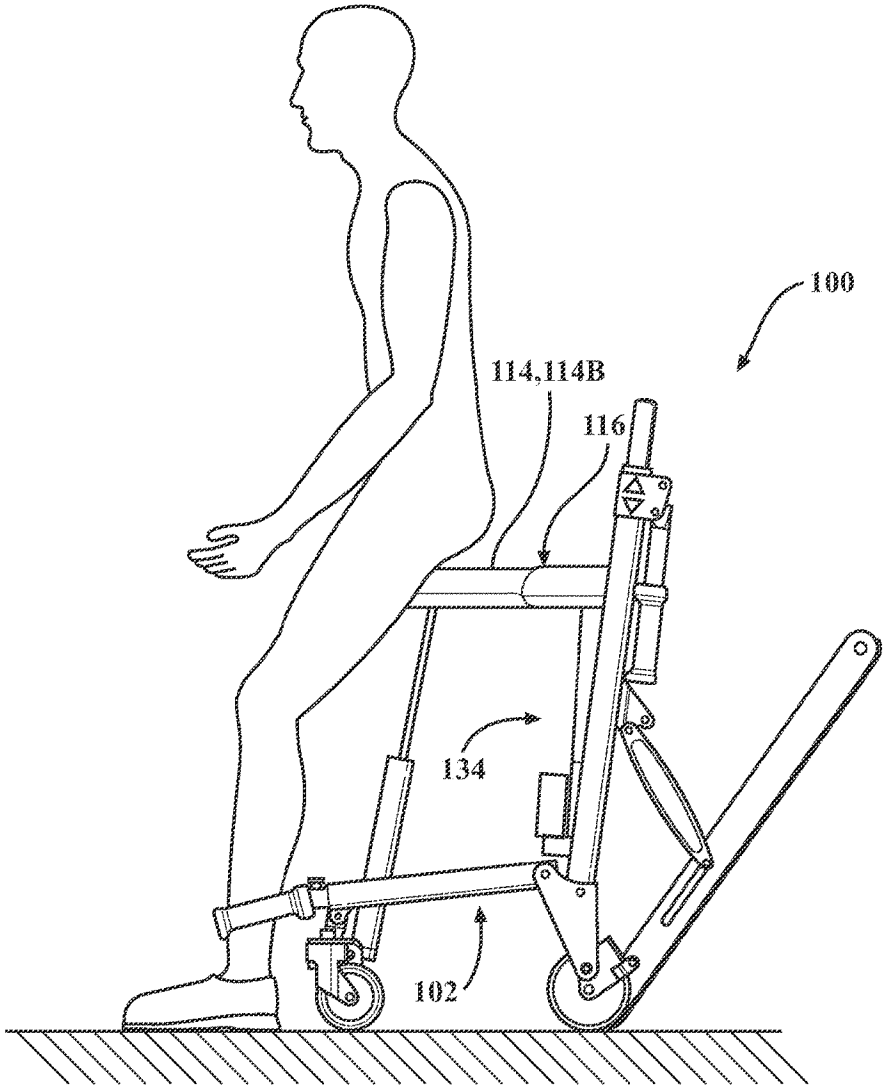
FIG. 3B is a side view of the stair chair with the seat section in the second vertical configuration transitioning a patient to a standing position.
Figure 3A:
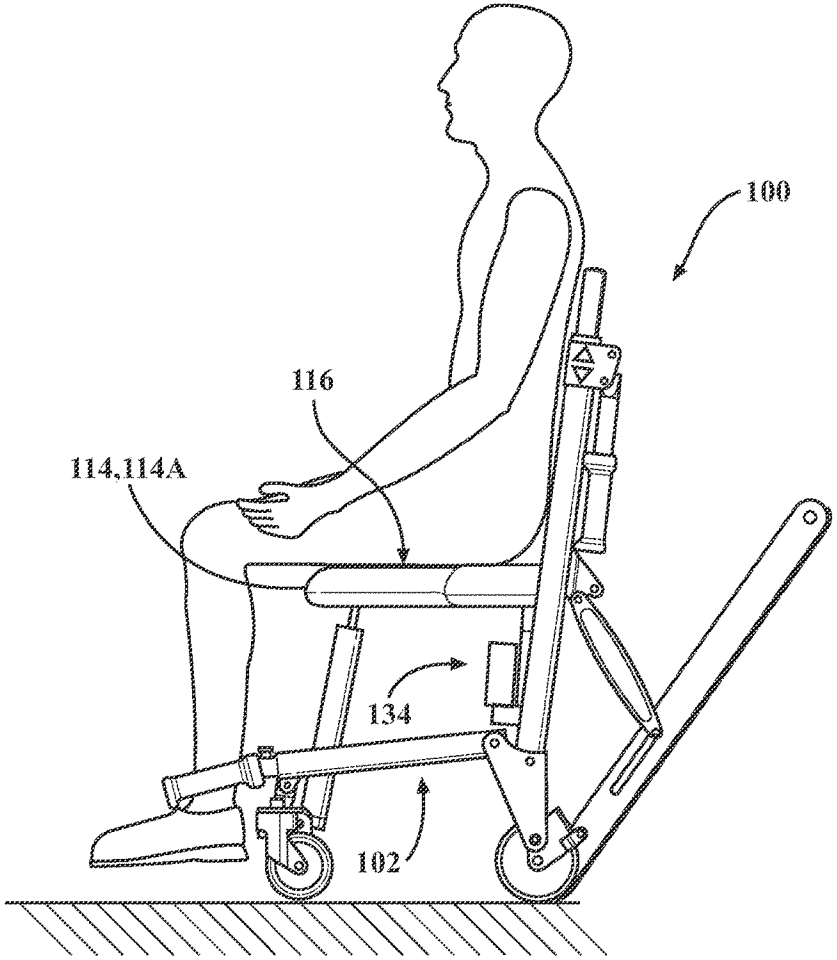
FIG. 3A is a side view of the stair chair with the seat section in the first vertical configuration supporting a patient in a seated position.

As is described in greater detail below, the seat section 114 of the stair chair 100 of the present disclosure provides support for the patient while transitioning from the seated position to the standing position, which is particularly advantageous for patients that have limited mobility. In FIG. 3A the stair chair 100 is shown with the seat section 114 in the first vertical configuration 114A and supporting the patient in the seated position. In FIG. 3B the stair chair 100 is shown with the seat section 114 in the second vertical configuration 114B supporting the patient for transitioning to a standing position.

To this end, the stair chair 100 comprises a lift mechanism 134 interposed between the seat section 114 and the base 102 to move the seat section 114 between the plurality of vertical configurations. As will be discussed below, the lift mechanism 134 is operable in a first mode to move the seat section 114 away from the first vertical configuration 114A and toward the second vertical configuration 114B for transitioning the patient to the standing position from the seated position.

Figure 1B:
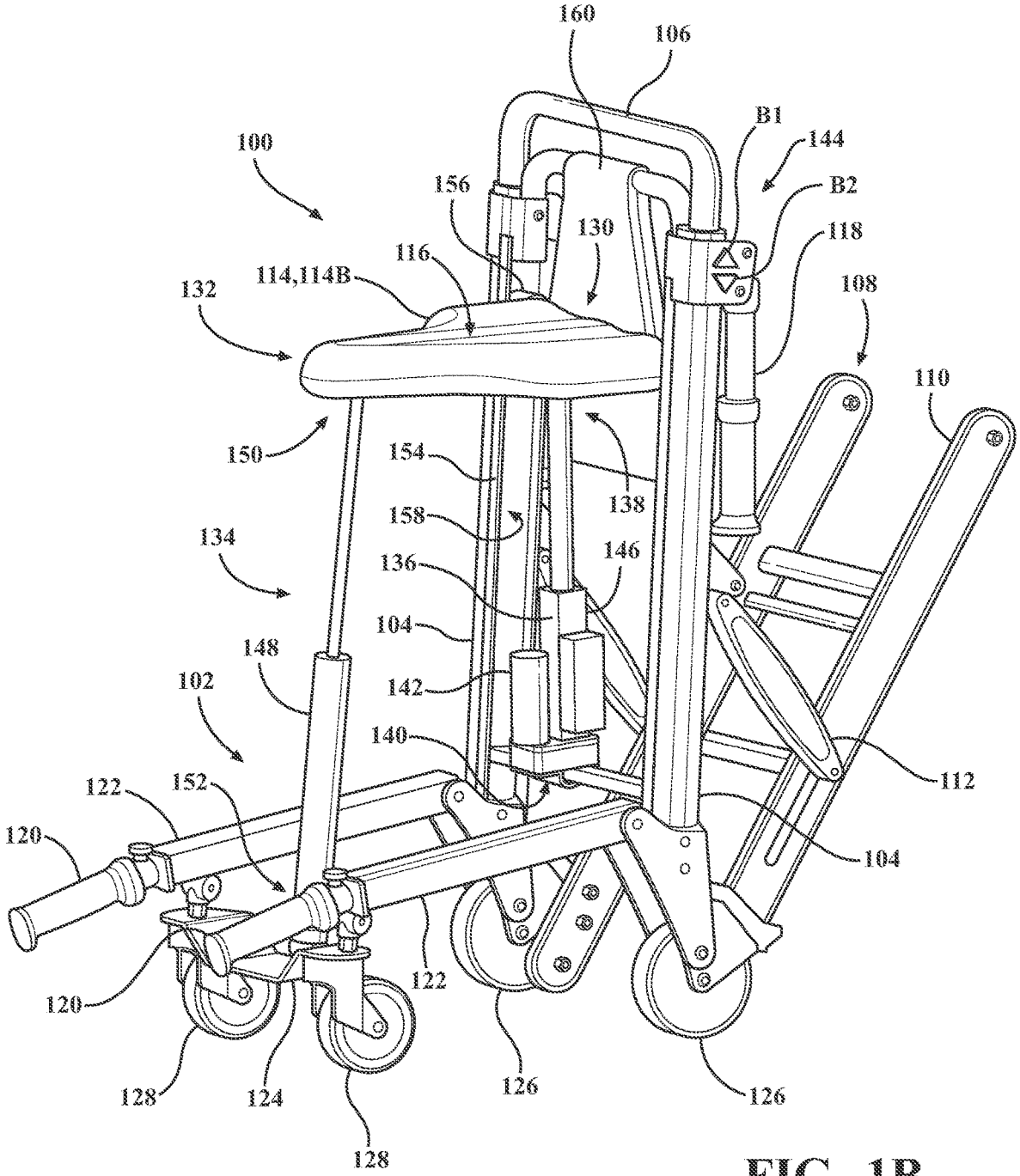
FIG. 1B is a perspective view of the stair chair of FIG. 1 with the seat section shown in a second vertical configuration.
Figure 2B:
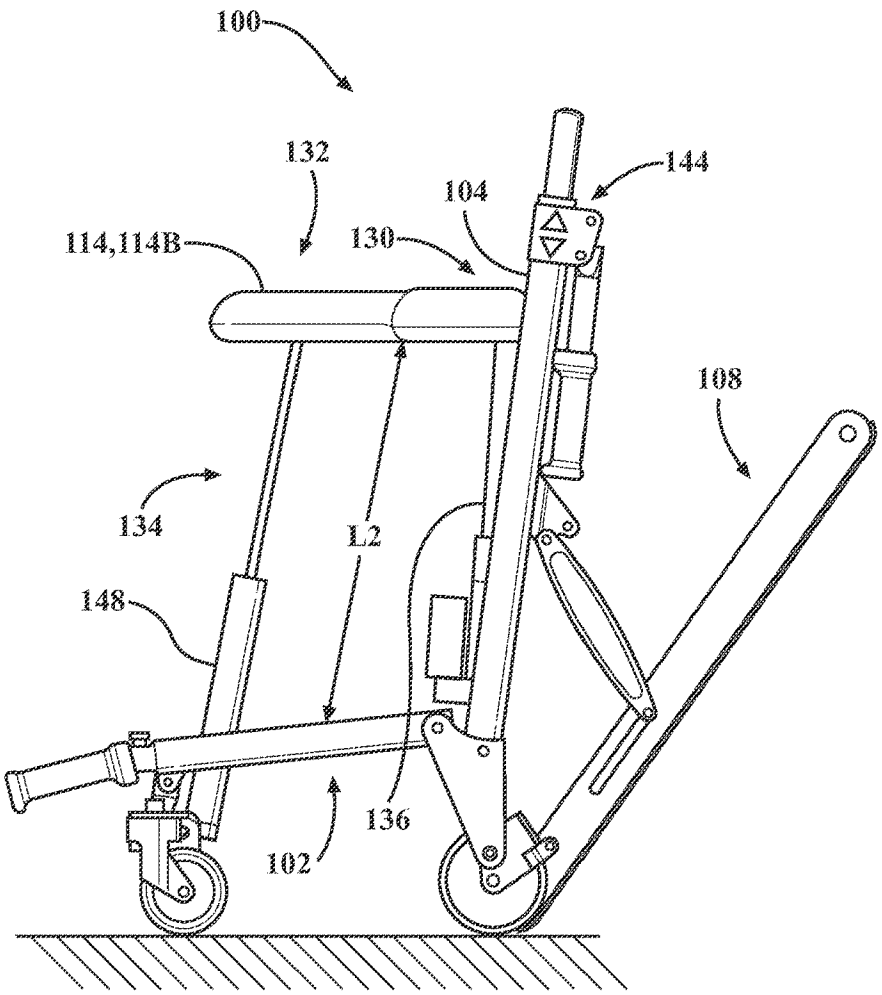
FIG. 2B is a side view of the stair chair of FIG. 1 with the seat section in the second vertical configuration.
Figure 2A:
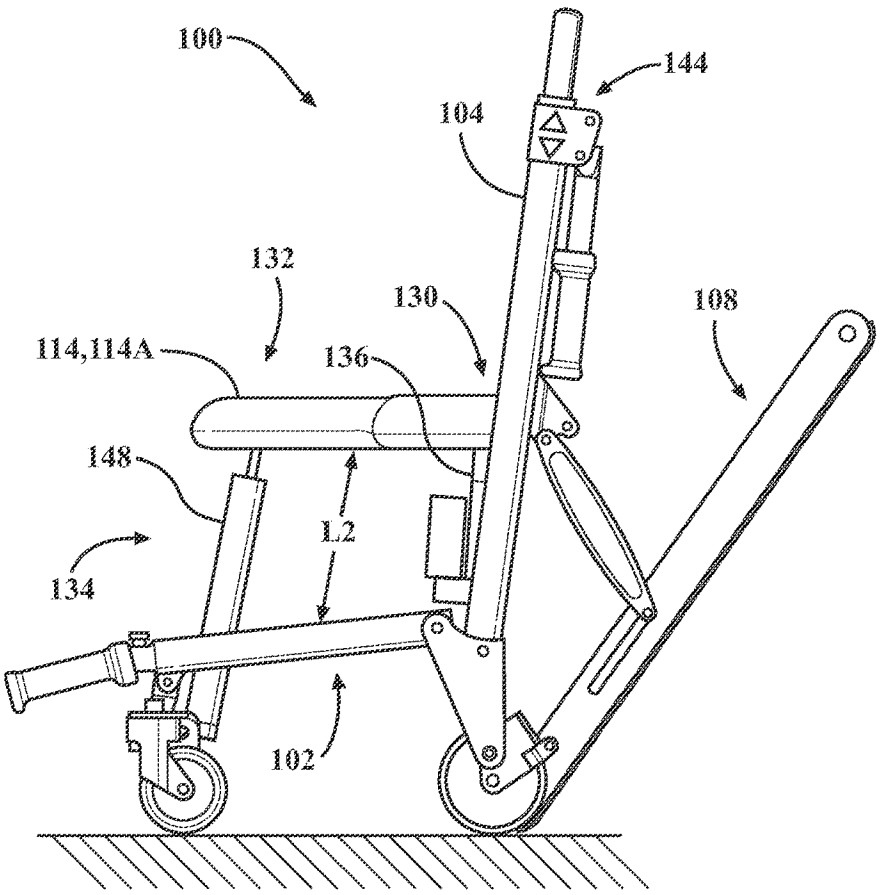
FIG. 2A is side view of the stair chair of FIG. 1 with the seat section in the first vertical configuration.
Figure 4B:
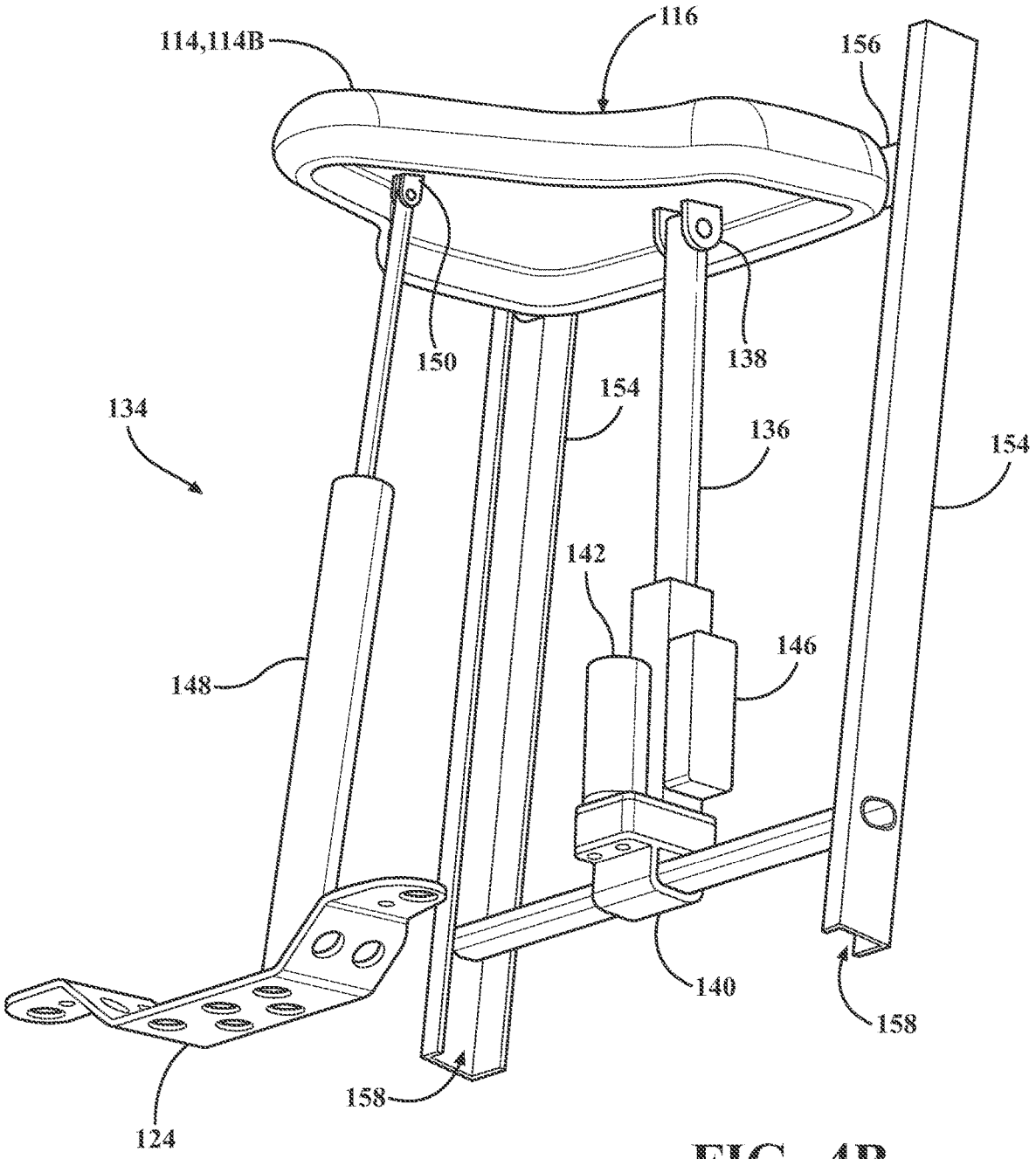
FIG. 4B is a bottom-side perspective view of the lift mechanism and seat section of FIG. 4A with the seat section in the second vertical configuration.

As is best shown in FIGS. 1A-1B and 4B, the lift mechanism 134 comprises an actuator 136 interposed in force-translating relationship between the base 102 and the seat section 114 to effect movement of the seat section 114 between the plurality of vertical configurations. The actuator 136 extends between a first joint end 138 and a second joint end 140. The first joint end 138 is coupled to the rear portion 130 of the seat section 114 to transfer force between the actuator 136 and the seat section 114, and allows the actuator 136 to pivot relative to the seat section 114. Similarly, the second joint end 140 is coupled to the base 102 and is arranged between the uprights 104 to transfer force between the actuator 136 and the base 102.

The lift mechanism 134 further comprises a support strut 148 interposed in force-translating relationship between the base 102 and the front portion 132 of the seat section 114. The support strut 148 supports the front portion 132 of the seat section 114 for movement between the first vertical configuration 114A and the second vertical configuration 114B. In the embodiment shown in FIGS. 1A-5 the support strut 148 extends between a first strut end 150 and a second strut end 152, with the first strut end 150 coupled to the front portion 132 of the seat section 114 and with the second strut end 152 coupled to the foot support 124. Each of the first strut end 150 and the second strut end 152 comprises a pivot joint to allow the support strut 148 to relative to both the seat section 114 and the base 102. It will be appreciated that the components of the lift mechanism 134 introduced above could be arranged or configured in other ways without departing from the scope of the present disclosure.

As mentioned above, the lift mechanism 134 is operable in the first mode to move the seat section 114 away from the first vertical configuration 114A and toward the second vertical configuration 114B for transitioning the patient to the standing position from the seated position. Here, as the patient transitions from the seated position toward the standing position, the seat section 114 moves in a generally vertical direction partially supporting the patient to gradually transfer weight of the patient off of the seat section 114.

The lift mechanism 134 is further operable in a second mode to restrict movement of the seat section 114 relative to the base 102, and in a third mode to move the seat section 114 toward the first vertical configuration 114A and away from the second vertical configuration 114B. In the second mode, the lift mechanism 134 restricts movement of the seat section 114 in order to fully support the patient in different vertical configurations. For example, in FIG. 3A, the seat section 114 is shown in the first vertical configuration 114A with the patient seated with their legs bent and their feet engaging the foot support 124. However, the patient could be seated higher up, with their legs hanging down and with their feet spaced above the foot support 124 when the seat section 114 is in the second vertical configuration 114B. It should be appreciated that differently-sized patients may be supported in correspondingly different ways. Thus, the second vertical configuration 114B may differ between patients. For example, a taller patient may be supported with the seat section 114 spaced at a greater distance to the base 102 than a shorter patient. Other configurations are contemplated.

In the third mode the lift mechanism 134 moves the seat section 114 toward the first vertical configuration 114A and away from the second vertical configuration 114B. More specifically, the lift mechanism 134 moves the seat section 114 closer to the base 102, which lowers the patient support surface 116. As the patient transitions away from the standing position into the seated position, the seat section 114 moves in a generally vertical direction, partially supporting the patient, to gradually transfer weight of the patient onto the seat section 114. By way of illustration, when the seat section 114 is in the second vertical configuration 114B, the patient may straddle the patient support surface 116 and gradually transfer their weight onto the seat section 114. Here, the stair chair 100 advantageously promotes improved stability by allowing the patient to be at least partially supported by the seat section 114 prior to operating the lift mechanism 134 in the third mode to move the seat section 114 toward the first vertical configuration 114A.

In one embodiment, the actuator 136 of the lift mechanism 134 is a linear actuator that is selectively operable between the first mode, the second mode, and the third mode. The actuator 136 may comprise an electric motor 142 that is operable to exert a tension force or a compression force between the first joint end 138 and the second joint end 140 to effect movement of the seat section 114 between the plurality of vertical configurations. The electric motor 142 may be configured to operate in a forward direction and/or a reverse direction, with the forward direction corresponding to the first mode of the lift mechanism 134 and the reverse direction corresponding to the third mode of the lift mechanism 134. The electric motor 142 may further be configured to operate in a braking manner, or may otherwise resist rotation and/or movement. Here, preventing movement of the lift mechanism 134 via the electric motor 142 corresponds to the second mode of the lift mechanism 134. Operation of the electric motor 142 may be controlled by a suitable controller 146, such as will be discussed below. It is further contemplated that the actuator 136 may employ a linkage (not shown) coupled to the electric motor 142 and operable to effect movement of the seat section 114. The linkage may be a crank-rocker linkage configured such that operation of the electric motor 142 in the forward direction corresponds to both the first mode and the third mode of the lift mechanism 134. More specifically, the electric motor 142 could cyclically operate the lift mechanism in the first mode and the third mode to move the seat section 114 between the first vertical configuration 114A and the second vertical configuration 114B. It will be appreciated that the first mode, the second mode, and/or the third mode could be achieved, effected, or otherwise provided by a number of different types of actuators 136. Other configurations are contemplated.

As is best shown in FIGS. 1A and 1B, the stair chair 100 further comprises a user input 144 coupled to the lift mechanism 134 and arranged for engagement by the caregiver to facilitate selecting between each of the modes of the lift mechanism 134. More specifically, the caregiver can engage the user input 144 to select whichever mode the lift mechanism 134 is to be operated in. One example of a user input 144 shown throughout the drawings comprises buttons arranged on the upright 104. Here, the user input 144 comprises two buttons, a first button B1 for selecting the first mode and a second button B2 for selecting the third mode. More specifically, the first mode of the lift mechanism 134 is selected when the caregiver engages the first button B1, the third mode of the lift mechanism 134 is selected when the caregiver engages the second button B2, and the second mode of the lift mechanism 134 is selected in the absence of engagement with either of the first button B1 and the second button B2. It should be appreciated that the user input 144 could be configured for engagement by both the caregiver and the patient alike in some embodiments. Moreover, the lift mechanism 134 can operate in each of the three modes irrespective of whether the patient seated on the seat section 114.

The user input 144 may comprise one or more devices capable of being engaged by the caregiver. Each user input 144 may be configured to be engaged in a variety of different ways, including, but not limited to, mechanical actuation (hand, foot, finger, etc.), hands-free actuation (voice, foot, etc.), and the like. Each user input 144 may comprise one or more buttons, a gesture sensing device for monitoring motion of hands, feet, or other body parts of the caregiver (such as through a camera), a microphone for receiving voice activation commands, a foot pedal, and a sensor (e.g., a pressure sensor, an infrared sensor such as a light bar or light beam to sense the caregiver's body part, an ultrasonic sensor, etc.). Additionally, the buttons/pedals can be physical buttons/pedals or virtually implemented buttons/pedals such as through optical projection or on a touchscreen. Other configurations are contemplated.

The buttons/pedals may also be mechanically connected to one or more portions of the lift mechanism 134, and/or may be electrically connected "drive-by-wire" type buttons/pedals where a user applied force actuates a sensor, such as a switch or potentiometer. In some embodiments, the user input 144 is disposed in electrical communication with the actuator 136 and is arranged for engagement by the caregiver to facilitate selecting between the first mode, the second mode, and the third mode. Here, the user input 144 may be a wireless keypad with one or more buttons for selecting a desired mode. Further, the user input 144 may also be realized via a portable electronic device (e.g., iPhone®, iPad®, or similar electronic devices) to select the mode of the lift mechanism 134. In embodiments where the user input 144 communicates wirelessly with the lift mechanism 134, the controller 146 may comprise a communication module configured to receive mode selections from the user input 144 to operate the lift mechanism 134. In some embodiments, the communication module may comprise a wireless radio to send and/or receive wireless control signals. The wireless radio may be any device capable of utilizing any suitable wireless transmission protocol at any frequency or wavelength of the electromagnetic spectrum, at any amplitude, either directly or indirectly via a remote cloud server including but not limited to: FM, AM, radio frequency (RF), infrared (IR), cellular, 3G, 4G, 5G, Bluetooth, Bluetooth Low Energy, Wi-Fi, RFID, near-field communication (NFC), VHF, UHF, analog, digital, optical, one-way, two-way, and combinations thereof. Other configurations are contemplated.

As noted above, other types and/or configurations of the actuator 136 are contemplated for the lift mechanism 134. For example, a hydraulic or pneumatic cylinder may be interposed in force-translating relationship between the base 102 and the seat section 114 to effect movement of the seat section between the plurality of vertical configurations. Here, extension, stoppage, and retraction of the cylinder corresponds to operation of the lift mechanism 134 in one of the first mode, the second mode, and the third mode. In other embodiments, the actuator 136 could be configured to operate in less than all of the first mode, the second mode, and the third mode.

Referring to the first embodiment of the stair chair 100 illustrated in FIGS. 4A-5 (see also FIGS. 1A-3B), the lift mechanism 134 and the foot support 124 are shown along with the saddle-profile embodiment of the seat section 114 described above. In this embodiment the support strut 148 is realized as a gas strut, which exerts force on the seat section 114 to move the seat section 114 toward the second vertical configuration 114B, and also help brace the front portion 132 of the seat section 114. Like the actuator 136 described above, the support strut 148 may also be operable in a first mode to move the seat section 114 toward the second vertical configuration 114B, and in a second mode to prevent movement of the seat section 114 relative to the base 102. The support strut 148 may also be disposed in communication with the user input 144 (e.g., via a linkage) to facilitate selecting between the first mode and the second mode. It is contemplated that the support strut 148 may also operate in a fourth mode, instead of the first mode, in which the support strut 148 does not exert any force on the seat section 114. Here, the caregiver could select between: the second mode, in which the support strut 148 prevents movement of the seat section 114; and the fourth mode, in which the support strut 148 allows the seat section 114 to move toward and away from the first vertical configuration 114A.

The lift mechanism 134 further comprises a rail 154 coupled to each of the uprights 104 such that the rails 154 face toward each other, and guides 156 coupled to the seat section 114 to ride in the respective rails 154. FIG. 5 shows an exploded view of the lift mechanism 134 and the seat section 114 of FIGS. 4A and 4B. Each rail 154 defines a channel 158 extending along the rail 154 configured to engage the respective guide 156. Here, the illustrated embodiment of the guide 156 is realized as a pair of rolling elements rotatably coupled to the rear portion 130 of the seat section 114. The guides 156 are disposed in sliding engagement with the channels 158 such that the guides 156 slide along their respective rails 154 as the seat section 114 moves between the plurality of vertical configurations.

Referring now to FIGS. 6A-9, a second embodiment of the seat section 214 is shown operatively attached to the upright 104, and is similarly arranged for movement relative to the base 102 between the plurality of vertical configurations. Here, the seat section 214 extends between a rear portion 230 and a front portion 232, with the rear portion 230 coupled to the upright 104. Like the first embodiment described above in connection with FIGS. 1A-5, the stair chair 100 illustrated in FIGS. 6A-9 also comprises a lift mechanism 234 interposed between the base 102 and the seat section 214 to move the seat section 214 between the plurality of vertical configurations.

Here, the lift mechanism 234 comprises a pair of support struts 248, each interposed in force-translating relationship between the base 102 and the front portion 232 of the seat section 214. The support struts 248 may be realized as gas struts, and exert force on the seat section 214 to move the seat section 214 away from the first vertical configuration 214A and toward the second vertical configuration 214B, and also help brace the front portion 232 of the seat section 214.

Here too in this embodiment, the stair chair 100 may be configured to fold into a collapsed position to facilitate transportation of the stair chair 100 (not shown). For example the seat section 114 and the lower rails 122 may fold upward to reduce depth of the stair chair 100. Further, in some embodiments, the actuator 136 may be operable to fold the lower rails 122 toward the upright 104. The caregiver may engage the user input 144 to operate the actuator 136 in a mode to fold the stair chair 100 into the collapsed position.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A stair chair for use in transporting a patient in a seated position along stairs, said stair chair comprising:
- a base;
- an upright coupled to said base;
- a track assembly extending from said base and comprising a track member for traversing stairs;
- a seat section defining a patient support surface and extending between a rear portion operatively attached to said upright, and a front portion, with said seat section being arranged for movement relative to said base between a plurality of vertical configurations including:
  - a first vertical configuration where said seat section is spaced from said base at a first distance for supporting the patient in the seated position; and
  - a second vertical configuration where said seat section is spaced from said base at a second distance greater than said first distance; and
- a lift mechanism including an actuator interposed in force-translating relationship between said base and said rear portion of said seat section to move said seat section between said plurality of vertical configurations, said lift mechanism being operable in a first mode to move said seat section away from said first vertical configuration and toward said second vertical configuration for transitioning the patient to a standing position from the seated position.

2. The stair chair as set forth in claim 1, wherein said lift mechanism is further operable in a second mode to restrict movement of said seat section relative to said base.

3. The stair chair as set forth in claim 2, further comprising a user input coupled to said lift mechanism and arranged for engagement by a user to facilitate selecting between said first mode and said second mode.

4. The stair chair as set forth in claim 3, wherein said lift mechanism is further operable in a third mode to move said seat section toward said first vertical configuration and away from said second vertical configuration.

5. The stair chair as set forth in claim 4, wherein said user input is configured to facilitate selecting between said first mode, said second mode, and said third mode.

6. The stair chair as set forth in claim 2, wherein said actuator is further defined as a linear actuator selectively operable between said first mode, said second mode, and a third mode to move said seat section toward said first vertical configuration and away from said second vertical configuration.

7. The stair chair as set forth in claim 6, further comprising a user input disposed in electrical communication with said linear actuator and arranged for engagement by a user to facilitate selecting between said first mode, said second mode, and said third mode.

8. The stair chair as set forth in claim 2, wherein said lift mechanism further comprises a support strut interposed in force-translating relationship between said base and said front portion of said seat section to support said front portion in a vertical direction.

9. The stair chair as set forth in claim 8, wherein said actuator is further defined as a linear actuator selectively operable between said first mode, said second mode, and a third mode to move said seat section toward said first vertical configuration and away from said second vertical configuration; and wherein said support strut is further defined as a gas strut.

10. The stair chair as set forth in claim 8, wherein said support strut is further defined as a first support strut; and further comprising a second support strut, with each of said first and second support struts interposed in force-translating relationship between said base and said front portion of said seat section.

11. The stair chair as set forth in claim 10, wherein said base comprises a first lower rail and a second lower rail with each of said first and second lower rails coupled to said upright and extending to a foot support, with said first and second support struts coupled, respectively, to said first and second lower rails.

12. The stair chair as set forth in claim 8, wherein said base comprises a first lower rail and a second lower rail with each of said first and second lower rails coupled to said upright and extending to a foot support.

13. The stair chair as set forth in claim 12, wherein said support strut extends between a first strut end and a second strut end, with said first strut end coupled to said front portion of said seat section and with said second strut end coupled to said foot support.

14. The stair chair as set forth in claim 13, wherein said rear portion of said seat section defines a rear width and said front portion of said seat section defines a front width; and wherein said front width is at least partially smaller than said rear width such that said seat section tapers between said front portion and said rear portion.

15. The stair chair as set forth in claim 14, wherein said seat section has a saddle-shaped profile defining said patient support surface.

16. The stair chair as set forth in claim 12, further comprising a caster wheel pivotably coupled to said foot support to facilitate movement along a floor surface.

17. The stair chair as set forth in claim 1, wherein said lift mechanism further comprises a rail coupled to said upright and defining a channel facing away from said upright, and a guide coupled to said rear portion of said seat section and disposed in sliding engagement with said channel such that said guide slides along said rail as said seat section moves between said plurality of vertical configurations.

18. A stair chair for use in transporting a patient in a seated position along stairs, said stair chair comprising:

a base;

an upright coupled to said base;

a rail coupled to said upright and defining a channel facing away from said upright;

a track assembly extending from said base and comprising a track member for traversing stairs;

a seat section defining a patient support surface, said seat section being operatively attached to said upright and arranged for movement relative to said base between a plurality of vertical configurations including:

a first vertical configuration where said seat section is spaced from said base at a first distance for supporting the patient in the seated position; and a second vertical configuration where said seat section is spaced from said base at a second distance greater than said first distance; and a lift mechanism coupled to said base and comprising a guide disposed in sliding engagement with said channel of said rail and coupled to said seat section to facilitate movement of said seat section between a plurality of vertical configurations, said lift mechanism being operable in a first mode to move said seat section away from said first vertical configuration and toward said second vertical configuration for transitioning the patient to a standing position from the seated position.

19. The stair chair as set forth in claim 18, wherein said lift mechanism comprises an actuator interposed in force-translating relationship between said base and a front portion of said seat section to effect movement of said seat section between said plurality of vertical configurations.

20. The stair chair as set forth in claim 18, wherein said guide is further defined as a rolling element rotatably coupled to a rear portion of said seat section.

* * * * *